US005150175A

United States Patent [19]

Whitman et al.

[11] Patent Number: 5,150,175

[45] Date of Patent: Sep. 22, 1992

[54] OPTICAL IMAGING SYSTEM FOR FABRIC SEAM DETECTION

[75] Inventors: Douglas L. Whitman, Pembroke; Adel K. Sarrafzadeh, Blacksburg, both of Va.

[73] Assignee: American Research Corporation of Virginia, Radford, Va.

[21] Appl. No.: 668,614

[22] Filed: Mar. 13, 1991

[51] Int. Cl.[5] ..... G01N 21/86

[52] U.S. Cl. ..... 356/429; 250/559; 356/238

[58] Field of Search ..... 356/238, 429, 430; 250/559, 562, 571, 572

[56] References Cited

U.S. PATENT DOCUMENTS

| | | | |
|---|---|---|---|
| 2,091,522 | 8/1937 | Perry | 73/159 |
| 2,645,939 | 7/1953 | Bates, Jr. et al. | 73/159 |
| 3,536,409 | 10/1970 | Belser et al. | 250/572 |
| 3,612,702 | 10/1971 | Troll | 356/430 |
| 3,748,414 | 7/1973 | Holm | 200/61.13 |
| 3,941,986 | 3/1976 | Santucci | 235/151.1 |
| 3,986,013 | 10/1976 | Brunette | 235/151.33 |
| 4,014,615 | 3/1977 | Clarke | 250/562 |
| 4,071,899 | 1/1978 | Holy | 364/561 |
| 4,323,786 | 4/1982 | Snow | 250/559 |
| 4,525,315 | 6/1985 | Greten | 264/40.4 |
| 4,857,747 | 8/1989 | Bolton et al. | 250/559 |
| 4,901,577 | 2/1990 | Roberts | 73/600 |
| 4,903,528 | 2/1990 | Balakrishnan et al. | 73/159 |

*Primary Examiner*—Richard A. Rosenberger
*Attorney, Agent, or Firm*—Dickstein, Shapiro & Morin

[57] ABSTRACT

A non-contacting optical imaging system for seam or other periodic pattern detection for a web of material such as a strip of fabric is disclosed in which a line scan camera is used to capture a seam or other periodic pattern image and the electrical output from the camera is converted to an alternating current signal and then to a direct current signal which is proportional to the presence or absence of a seam other periodic pattern. The DC signal is integrated and then compared to a preset reference value to produce a signal for driving an alarm, display or machine control devices.

17 Claims, 3 Drawing Sheets

OPTICAL IMAGING SYSTEM FOR FABRIC SEAM DETECTION

BACKGROUND OF THE INVENTION

The present invention is directed to an optical imaging system for fabric seam detection in which there is no contact between the sensor and the web of material being monitored.

During the course of manufacturing various webs of material, for example, textiles, such materials are typically processed in the form of long strips. Since it is often time consuming and costly to start up equipment and machinery for processing such long webs of material, such machinery frequently operates continuously for long periods of time during which it is desirable that the web being processed be formed into one continuous element. However, such a continuous web of material is invariably fabricated by piecing together shorter lengths of such web material. For example, in textile manufacturing, the continuous web of fabric processed by the textile machinery is formed by sewing together shorter lengths of fabric.

The result of such a procedure for forming a single continuous web of material is that seams or other periodic patterns are introduced into the web at periodic but unpredictable intervals. The detection of the seams or other periodic patterns is of great concern to the web manufacturers, since such seams or discontinuities are generally somewhat thicker than the web of material being processed and can frequently damage the processing machinery.

An example of the prior art approach to the detection of seams or other protrusions on a running web is shown in U.S. Pat. No. 3,748,414, issued on Jul. 24, 1973, to Holm. The device disclosed in that patent utilizes a sensor which bears against the web surface. A pair of spaced parallel rollers mounted on a common pivoted bracket engage opposite sides of the web. One roller is positioned opposite the sensor and the other roller is positioned opposite a fixed position roller. A mechanism is provided for urging the pivoted rollers against the web surfaces such that a change in web thickness will automatically calibrate the sensor to the roller gap by self-adjustment of the pivoted rollers.

The system of Holm has the disadvantage that it is a contacting type of web measurement system with the attendant drawbacks that such a contacting system is mechanical in nature and thus prone to frequent adjustment and/or malfunction and that such mechanical systems can have the effect of damaging or discoloring the web they are used to monitor.

U.S. Pat. No. 2,091,522, issued on Aug. 31, 1937, to Perry, shows a seam or defect detector for sheet material for use in connection with a measuring table over which the sheet material is drawn and utilizes a mechanical system which contacts the web and indicates when a seam or defect has been detected. The seam detector of Perry, however, suffers from the same drawbacks as that of Holm, because it is a mechanical contact type system and therefore requires frequent adjustment. It also uses operating parts which may become worn or inoperative.

A non-contacting approach for detecting splices in the web of a printing press is shown in U.S. Pat. No. 4,901,577, issued Feb. 20, 1990, to Roberts. In that patent, the web in a high speed printing press passes between a transmitter and receiver. The transmitter produces ultrasonic sound which is received by the receiver after attenuation by the web. The received ultrasonic sound is converted into an oscillating electrical signal of corresponding frequency which, after being amplified and filtered, is impressed upon a peak detector and comparator is long as no splices are found in the web, the reference potential remains undisturbed. In the event a splice is detected, a periodic pattern is created by the comparator in its oscillating signal. That periodic pattern is detected and is utilized to trigger a marking device for imparting a suitable mark to the web both before and after the splice.

A method and apparatus for analyzing the formation of a web of material by generating a formation index utilizing a linear array CCD camera is shown in U.S. Pat. No. 4,857,747, issued Aug. 15, 1989, to Bolton et al. In that patent, a light source is located beneath and perpendicular to the direction of movement of a web of material and the web passes between the light source and the CCD camera. The camera generates signals corresponding to the light intensity across the entire width of the web as compared to a single point for sample measurements. The signals are then processed to generate a full width formation profile of the web in real time. Utilizing a pulse generator which is coupled to a roller which engages the web, the scanning rate of the camera is regulated such that it corresponds to the speed of the web.

The Bolton et al. system is directed to a web formation system, and not a web inspection system, as is the present invention. In the Bolton et al. system, all light intensity variations are measured for a given area and not just the areas that exceed preset threshold limits.

Thus, in the Bolton et al. system, the light intensities across the entire web are converted into analog electrical signals which are in turn converted into digital signals.

The Bolton et al. system is not directed to a web inspection system and can only be used in instances where the web allows light to pass through it. Thus, for many applications in which the web is not transparent, the Bolton et al. system is not operative. Furthermore, the Bolton et al. system is complex and utilizes a large amount of electronic equipment for operation.

SUMMARY OF THE INVENTION

In view of the foregoing, it should be apparent that there still exists a need in the art for a system for detecting a seam or other periodic pattern or closely spaced periodic objects in a moving web in which an optical mechanism is utilized in a simple and precise manner to accomplish the detection. It is, therefore, a primary object of this invention to provide a system for detecting a seam or other periodic pattern in a moving web of material which is characterized by simple electronic circuitry and which has particular application as a fabric seam detector.

More particularly, it is an object of this invention to provide an optical imaging system for detection of a seam or other periodic pattern which has simple and reliable electronic circuitry which does not require frequent alignment or costly components.

Still more particularly, it is an object of this invention to provide an optical detector for detecting seams or other periodic patterns in a web of material in which a CCD camera is utilized to produce an alternating current signal which varies depending upon whether a seam or other periodic pattern is present.

Another object of the present invention is to provide a reliable and relatively inexpensive optical imaging system for detecting a fabric seam for use as a peripheral sensor for textile machinery.

Briefly described, these and other objects of the invention are accomplished by providing a charge-coupled-device (CCD) line scan camera which captures the seam or other periodic pattern image of a moving web. The web is illuminated from the side in order to create maximum contrast between the seam or periodic patterns and their shadows. The video output from the line scan camera is processed by an analog band pass filter to produce an alternating current signal which has a large magnitude when a seam or other periodic pattern is present and a small magnitude when a seam or periodic pattern is absent. The AC signal from the filter is then converted to a DC signal having a level proportional to the magnitude of the filtered AC signal. This DC signal is compared to a predetermined threshold value in order to determine the presence or absence of a seam or other periodic pattern. When a seam or other periodic pattern is detected, the comparison circuitry drives the appropriate output circuitry, such as a bell, relay, etc. for interfacing with the web processing machinery controls.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
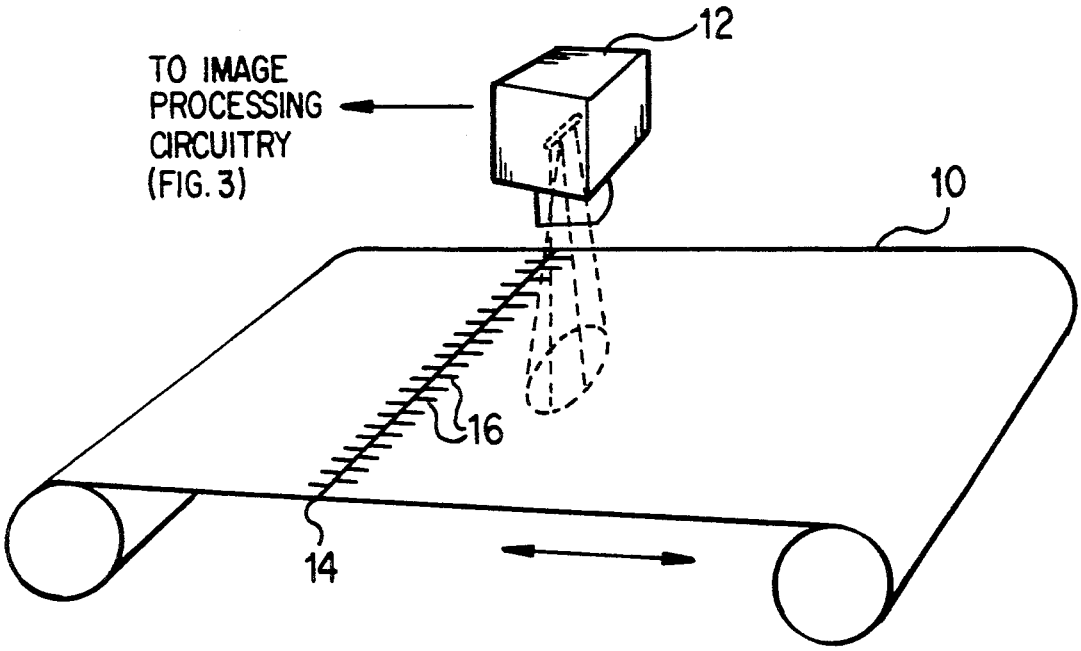
FIG. 1 is a schematic diagram showing the application of the present invention to a fabric seam detector using non-contacting optical imaging techniques.

Referring now in detail to the drawings wherein like parts are designated by like reference numerals throughout, there is shown in FIG. 1 a schematic diagram of the application of the present invention as a fabric seam detector. It should be understood that the system of the present invention can be used in applications where the image to be detected exhibits a linear periodicity, such as in the case of textile seam, laser weld, diffraction gratings or corrugated object. In addition, the system of the present invention can be used to detect a two-dimensional periodicity such as would be needed to evaluate the density of a two-dimensional weave, the texture of paper or defects in plywood. However, for purposes of explanation, the present invention is described in the context of a fabric seam detector using non-contacting optical imaging techniques.

Accordingly, there is shown in FIG. 1 a web of fabric material 10 which is moving in one of two directions denoted by the arrow past a camera 12 which may preferably be a line scan CCD camera. However, it should be understood that other types of video cameras can be utilized, including, but not limited to, cameras utilizing tubes, such as VIDICON cameras, visible and non-visible light sensitive cameras and image intensified cameras. Visible light sensitive cameras are sensitive to the visible light range (red, orange, yellow, blue, violet and are typically used in home video apparatus. Non-visible light sensitive cameras are sensitive to light energy that falls beyond the visible limit of red (infra-red) and/or beyond the visible limit of violet (ultra-violet). Non-visible (infra-red) cameras are typically used in aerial agricultural surveys to locate concentrations of diseased foliage due to their lower emission of infra-red energy.

Image intensified cameras can operate at extremely low light levels due light amplification which occurs within a vacuum tube image intensifier placed at the front of the camera. Such cameras are used for night time surveillance. Current military night vision goggles utilize image intensifiers which also operate in the non-visible, infra-red light range.

The camera 12 is situated in a plane parallel to that of the moving fabric 10 such that it can readily detect a seam 14 which extends across the web of fabric 10 perpendicular to the direction of travel of the fabric 10. Typically, such seams 14 include a plurality of threads 16 which are used to secure two pieces of fabric into a larger piece of fabric. The output from the line scan camera is fed to the image processing circuitry shown in FIG. 3.

Figure 2:
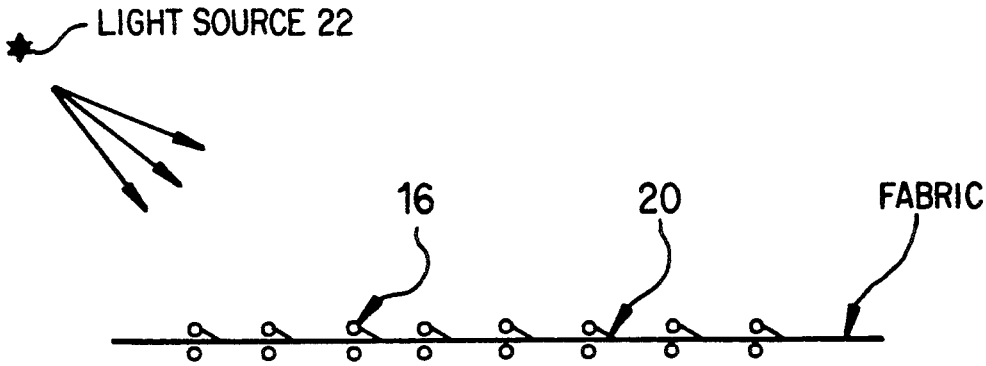
FIG. 2 is a schematic diagram of the lateral cross-section of a fabric seam showing lighting contrast for the seam thread.

FIG. 2 shows the position of a light source 22 to one side of the fabric web 10 such that, when such light impinges on the plurality of threads 16, a shadow 20 is formed.

Figure 5:
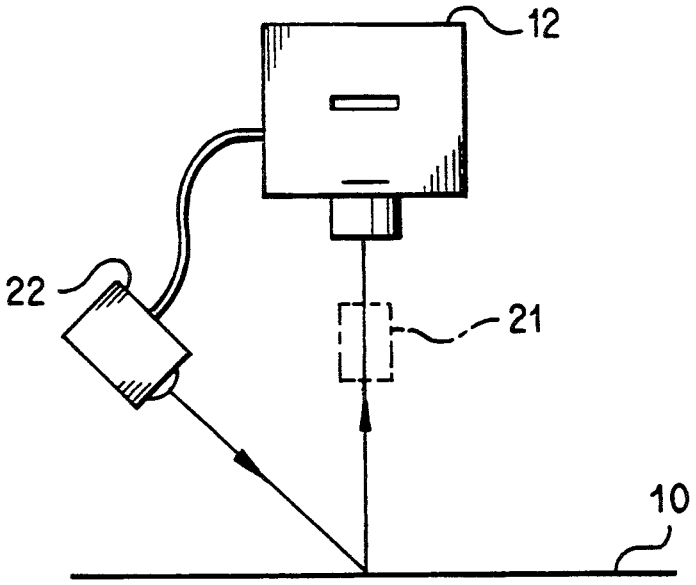
FIG. 5 shows a lighting configuration for the present invention when used with a fabric web having a seam.

The light source 22, as is also shown in FIG. 5, is set at an angle oblique to the top surface of the moving web of fabric 10 so as to create the maximum contrast between the seam threads 16 and their shadows.

Figure 3:
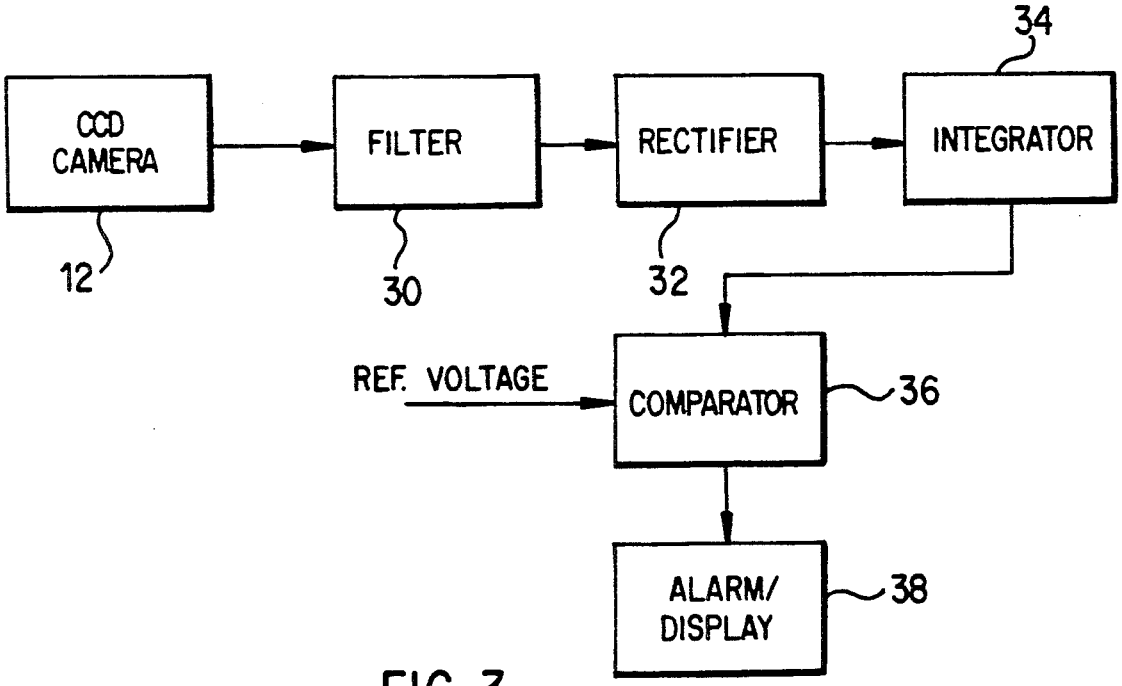
FIG. 3 is a block diagram showing the apparatus of the present invention.

Referring now to FIG. 3, there is shown the image processing circuitry for use with the present invention. The video output from the CCD camera 12 is processed by a filter 30, which may be an analog bandpass filter. The filter 30 is tuned to the expected or predetermined spatial frequency of the seam. Since the camera converts spatial frequency to a time frequency, the filtering is accomplished utilizing standard electronic audio frequency or radio frequency methods. The signal which is output from the filter 30 is an alternating current signal which has a large magnitude when a seam is present and a small magnitude when a seam is not present. At this point in the processing circuitry, signal variations due to the printed pattern of the fabric, fabric thread defects, such as weave or knit and the brightness or reflectivity of the fabric are eliminated or have been significantly attenuated.

The AC signal output from the filter 30 is then converted to a DC signal with a level proportional to the magnitude of the filtered AC signal by passing the AC signal output from the filter 30 through a rectifier 32. The rectifier 32 is preferably a half-wave rectifier (although it could also be full wave rectifier) which creates a time varying signal that is always positive (or negative) with respect to ground. The rectified signal is then fed to an integrator 34 which serves to produce a signal that represents a summation of all of the individual imaged threads 16 which make up a seam 14. If there are few or no seam threads 16 present, then the magnitude of the signal produced by the integrator 34 is low. Otherwise, the magnitude of the signal produced by the integrator 34 is high.

The output from the integrator 34 is then applied to a comparator 36 where it is compared to a manually or automatically adjustable reference voltage. The result of this comparison is used to drive an alarm or display 38 or to provide a signal for interfacing with the controls of the fabric processing machinery.

Figure 4A:
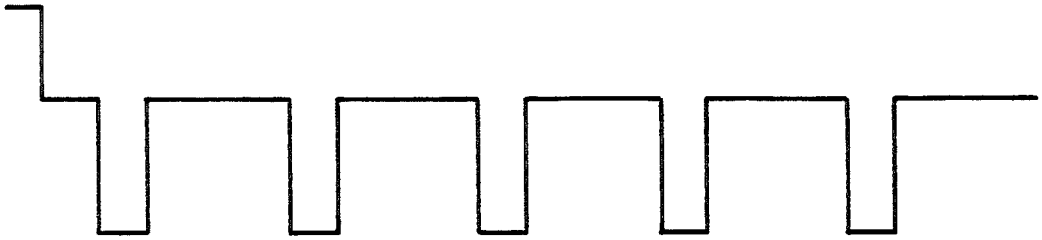
FIG. 4*a* shows a typical video signal of the line scan imager where a seam or other periodic pattern has been detected.

FIG. 4*a* shows a typical video output from the line scan camera 12 which identifies the presence of a seam.

Figure 4B:
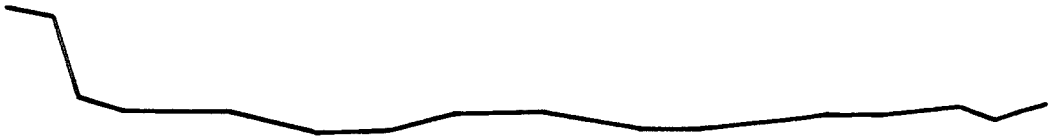
FIG. 4*b* shows a typical video signal of the line scan imager in which a seam or other periodic pattern has not been detected.

FIG. 4*b* shows a typical video output from the camera 12 in which no seam has been imaged.

FIG. 5 shows the lighting configuration for the present invention in which the camera 12 is used to capture the seam image. The camera 12 is placed perpendicular to the direction of motion of the fabric 10. The linear imager of the camera 12 is arranged to be parallel to the axis of the seam, as shown in FIG. 1. The optical image entering the camera 12 is filtered through a long pass infrared filter in order to allow the camera 12 to be "color blind" and to prevent the seam detector system from incorrectly identifying a densely printed fabric pattern within the visible light range. Fabric dyes are generally selected to impart a certain visible color or hue to the fabric. These dyes typically do not impart "color" beyond the visible range. Therefore, fabric which has been printed with a visible pattern will have little or no pattern when observed by an infra-red sensitive camera.

It will be apparent to those of ordinary skill in the art that because the optical imaging system described herein relies upon electronic filtering of a one-dimensional signal, it can be used to provide an inexpensive, rapid, non-contacting method of seam detection for textile manufacturing, apparel production, industrial weaving or other webs in which the location of seams is required.

The system described herein performs its detection function based upon web thread topography and ignores color variations. However, such configuration may be unacceptable for use with textured fabric. In order to use the system of the present invention for the detection of seams in textured fabric, the infrared long pass optical filter used with the camera 12 may be replaced by an infrared short pass filter. The system of the present invention, when thus configured, will detect seams based upon color variations but will be insensitive to texture variations.

The system described herein can be further improved by the addition of a cylindrical lens 21 between the web and camera lens or between the camera lens and the camera. This cylindrical lens would minimize false triggering due to periodic texture (holes) present in some fabric such as some double knits. The effect of this lens is to defocus or blur these small holes in a direction parallel to the seam threads while maintaining sharp focus perpendicular to the threads. This technique would result in the blurring of holes without the blurring of seam threads.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A method for detecting a seam or other closely spaced periodic object in a moving web having top and bottom surfaces, comprising the steps of:

illuminating the top surface of said moving web;

receiving light reflected by said moving web as a result of said step of illuminating using camera means aligned across the width of said moving web;

converting said reflected light into corresponding electrical signals;

reading out said electrical signals from said camera means for processing;

filtering the converted corresponding electrical signals to produce an alternating current signal having a magnitude proportional to the presence of a seam or other closely spaced periodic object;

processing said alternating current signal to produce a direct current signal corresponding to said reflected light; and comparing said direct current signal to a predetermined reference value to determine whether a seam or other closely spaced periodic object has been detected.

2. The method of claim 1, further including the step of filtering said light reflected by said moving web prior to said step of converting said reflected light into corresponding electrical signals.

3. The method of claim 1, further including the step of integrating said direct current signals.

4. The method of claim 1, wherein said processing step rectifying said corresponding electrical signals.

5. The method of claim 1, further including the step of actuating at least one of an alarm, relay, machine control and display when a seam or other periodic object has been detected.

6. The method of claim 1, wherein said seams or other closely spaced periodic objects are detected regardless of the color or texture of said moving web.

7. The method of claim 1 wherein said method is utilized to detect a seam in a moving web of fabric.

8. The method of claim 1, wherein said method is utilized to detect seams in one of knitted, denim, corduroy and plush fabrics.

9. The method of claim 1, wherein said method is utilized to detect a laser weld seam in said moving web.

10. The method of claim 1, wherein said step of illuminating is performed at an angle of approximately 45° to a plane parallel to the top surface of said moving web.

11. The method of claim 1, further including the step of positioning a cylindrical lens between said top surface of said moving web and said camera means for optimizing detection of said seam.

12. Apparatus for detecting a seam or other closely spaced periodic object in a moving web having top and bottom surfaces, comprising:

a source of illumination for illuminating the top surface of said moving web;

a camera aligned across the width of said moving web for receiving light reflected off of said top surface of said moving web and for converting said light into electrical signals which are read out for processing;

filter means for filtering said read out electrical signals to produce an alternating current signal having a magnitude proportional to the presence of a seam or other closely spaced periodic object;

circuitry for processing said alternating current signal to produce a direct current signal proportional to said received light; and comparison circuitry for comparing said direct current signal to a predetermined reference value to determine if a seam or other periodic object has been detected.

13. The apparatus of claim 12, further comprising integrating circuitry for producing a signal corresponding to a sum of the direct current signals over time.

14. The apparatus of claim 12, further comprising at least one of alarm and display and indicator devices connected to said companion circuitry for providing an indication of the detection of a seam or other closely spaced periodic object.

15. The apparatus of claim 12, wherein said source of illumination is positioned such that it illuminates said top surface of said moving web from an angle of approximately 45° to a plane parallel to said top surface of said moving web.

16. The apparatus of claim 12, wherein said camera comprises a filter in order to allow said apparatus for detecting to not be affected by a color, texture or pattern appearing on said moving web.

17. The apparatus of claim 12, further including a cylindrical lens positioned between said top surface of said moving web and said camera for optimizing detection of said seam.

* * * * *